US009670803B2

(12) United States Patent
Pegg et al.

(10) Patent No.: US 9,670,803 B2
(45) Date of Patent: Jun. 6, 2017

(54) CRANKCASE OIL CATCHER

(71) Applicant: Ford Global Technologies, LLC, Dearborn, MI (US)

(72) Inventors: Ian Graham Pegg, Chelmsford (GB); Roland Paul Stark, Hitchin (GB)

(73) Assignee: Ford Global Technologies, LLC, Dearborn, MI (US)

( * ) Notice: Subject to any disclaimer, the term of this patent is extended or adjusted under 35 U.S.C. 154(b) by 111 days.

(21) Appl. No.: 14/624,177

(22) Filed: Feb. 17, 2015

(65) Prior Publication Data

US 2015/0252697 A1 Sep. 10, 2015

(30) Foreign Application Priority Data

Mar. 10, 2014 (GB) ..... 1404205.5

(51) Int. Cl.
*F01M 11/00* (2006.01)
*F01P 3/08* (2006.01)

(52) U.S. Cl.
CPC ..... *F01M 11/0004* (2013.01); *F01P 3/08* (2013.01); *F01M 2011/0033* (2013.01); *F01M 2011/0091* (2013.01)

(58) Field of Classification Search
CPC ..... F01M 11/0004; F01M 2011/0033; F01M 2011/005; F01M 2011/0091; F01P 3/08
See application file for complete search history.

(56) References Cited

U.S. PATENT DOCUMENTS

| | | | | |
|---|---|---|---|---|
| 4,726,334 | A * | 2/1988 | Holtzberg | F02F 7/0085 123/195 R |
| 5,517,959 | A | 5/1996 | Kato et al. | |
| 7,341,039 | B1 | 3/2008 | Jaszewski et al. | |
| 2004/0177826 | A1 | 9/2004 | Duwel | |
| 2009/0277416 | A1 | 11/2009 | Saito | |
| 2011/0253092 | A1 | 10/2011 | Springer et al. | |
| 2012/0067319 | A1 | 3/2012 | Cygan, Jr. et al. | |
| 2014/0305399 | A1 | 10/2014 | Pegg et al. | |

FOREIGN PATENT DOCUMENTS

| | | | |
|---|---|---|---|
| DE | 3618794 | A1 | 12/1987 |
| DE | 4431133 | A1 | 3/1996 |
| GB | 2437089 | A | 10/2007 |

(Continued)

OTHER PUBLICATIONS

Examination Report of Great Britain Patent Application No. 1404205.5, Dec. 15, 2016, 3 pages, United Kingdom Intellectual Property Office.

*Primary Examiner* — Jacob Amick
(74) *Attorney, Agent, or Firm* — Greg Brown; McCoy Russell LLP

(57) ABSTRACT

A crankcase oil catcher configured for placement above a crankshaft and below a piston is described. In one particular example, the crankcase oil catcher has a contour that catches dispersed oil within the crankcase while directing the oil away from a casing wall and towards a crank sump along the contoured surface of the crankcase oil catcher. Inclusion of an aperture within the surface allows for passage of a connecting rod of the crankshaft while providing for a protruding lip around the perimeter of the aperture that prevents oil on the top surface from falling through the aperture.

19 Claims, 5 Drawing Sheets

(56) References Cited

FOREIGN PATENT DOCUMENTS

| | | | |
|---|---|---|---|
| GB | 2496765 | B | 4/2014 |
| GB | 2507976 | A | 5/2014 |
| GB | 2525863 | A | 11/2015 |
| JP | 2008267163 | A | 11/2008 |
| WO | 2013083765 | A1 | 6/2013 |

* cited by examiner

CRANKCASE OIL CATCHER

CROSS REFERENCE TO RELATED APPLICATIONS

The present application claims priority to Great Britain Patent Application No. 1404205.5, entitled "Crankcase Oil Catcher," filed Mar. 10, 2014, the entire contents of which are hereby incorporated by reference for all purposes.

FIELD

The present description relates to a crankcase oil catcher, and in particular, but not exclusively, a crankcase oil catcher configured to catch dispersed oil in a crankcase and direct the oil towards a crank sump and away from a crankcase casing wall.

BACKGROUND AND SUMMARY

During warm up of an internal combustion engine, the engine block structure acts as a large heat sink because the thermal inertia of the engine block structure is an order of magnitude greater than the coolant and oil. For this reason, the engine block structure may take longer to warm up than the oil. By way of example, hot oil returning from a piston cooling gallery, which has been heated by combustion events, may hit a crank of the engine and the oil may be thrown against the cooler crankcase. When oil is thrown against the crankcase wall, the oil may lose heat due to the large thermal inertia and large surface area of the crankcase. Similarly, oil returning from the cylinder head has been heated and may lose heat upon returning through the engine block to the oil sump. The resulting colder oil has a higher viscosity, which may lead to higher frictional losses, and in turn, higher fuel consumption and/or a reduced cabin heating.

Exemplary oil pans and windage trays are known whose inclusion in an engine block acts as a barrier between a wet sump area of the engine and the crankshaft. Such apparatuses may act to reduce the amount of windage or aeration of the oil within the engine. However, previous examples locate the tray between the crankshaft of the engine and the sump. For example, US2012/0067319, WO2013/083765, and US2009/0277416 describe apparatuses configured for placement below the crankshaft. U.S. Pat. No. 7,341,039 alternatively describes an engine with a tilted in-line configuration, and accordingly locates the windage tray between the sump and the connecting rod coupling to the piston. US2004/0177826 describes windage tray with an inverted arrangement. However, the disclosed apparatus is designed to block air and oil turbulence caused by the rotating crankshaft, and the apparatus shown is also configured for placement beneath a connecting rod that couples a piston to the crankshaft. The systems above, thus, lack an ability to reduce thermal losses due contact interactions between oil and the engine block structure. Specifically, heated engine oil may still hit an engine crank and even be thrown against the crankcase wall, which leads to higher frictional losses, and increases the duration of time for oil heating in some instances.

The inventors have recognized issues with such approaches and herein describe a crankcase oil catcher configured for placement above a crankshaft and below a piston of an engine. In particular, the crankcase oil catcher comprises one or more contoured surfaces for catching dispersed oil in the crankcase and directing the dispersed oil along the one or more contoured surfaces of the crankcase oil catcher to a crank sump. Advantageously, the crankcase oil catcher includes a first aperture for a connecting rod of the crankshaft to pass through. In this way, the technical result is achieved that dispersed oil within the crankcase can be caught by the crankcase oil catcher and directed to the sump without experiencing thermal losses due to contact with the engine structure.

In one disclosed example, the crankcase oil catcher is configured for placement above a crankshaft and below a piston while a top surface of the crankcase oil catcher has a contour further configured to follow a contour of a crankcase wall while maintaining a substantially constant spacing therefrom. In this way, the top surface allows dispersed oil in the engine crankcase to be caught and directed to a crank sump along the top surface of the crankcase oil catcher while preventing oil from contacting the crankcase casing wall. Further inclusion of an aperture whose width is smaller than a width of the piston associated with a connecting rod of the engine crankshaft then allows for providing the crankcase oil catcher beneath an engine cylinder, and thus for increasing the amount of oil caught therefrom. As described in greater detail below, the aperture is sized only for passage of the crankshaft. Additional structural features like a lip protruding in a direction of the piston extending around a perimeter of the aperture further prevent oil on the top surface from falling through the aperture.

The above advantages and other advantages, and features of the present description will be readily apparent from the following Detailed Description when taken alone or in connection with the accompanying drawings. It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

The advantages described herein will be more fully understood by reading an example of an embodiment, referred to herein as the Detailed Description, when taken alone or with reference to the drawings, where.

DETAILED DESCRIPTION

The present description relates to an engine with a crankcase oil catcher. In other words, an engine, such as an internal combustion engine, may comprise the above-mentioned crankcase oil catcher. Similarly, a vehicle, such as an automobile, van or any other motor vehicle, may comprise the above-mentioned crankcase oil catcher. A crankcase oil catcher according to the present disclosure is configured to be provided for a single cylinder of an engine. In other words, one crankcase oil catcher may be provided per piston. In some instances, the crankcase oil catcher may be configured to be provided between walls between neighboring cylinders of the engine. However, it is also envisaged that the crankcase oil catcher may extend beneath a plurality of pistons.

Figure 1:
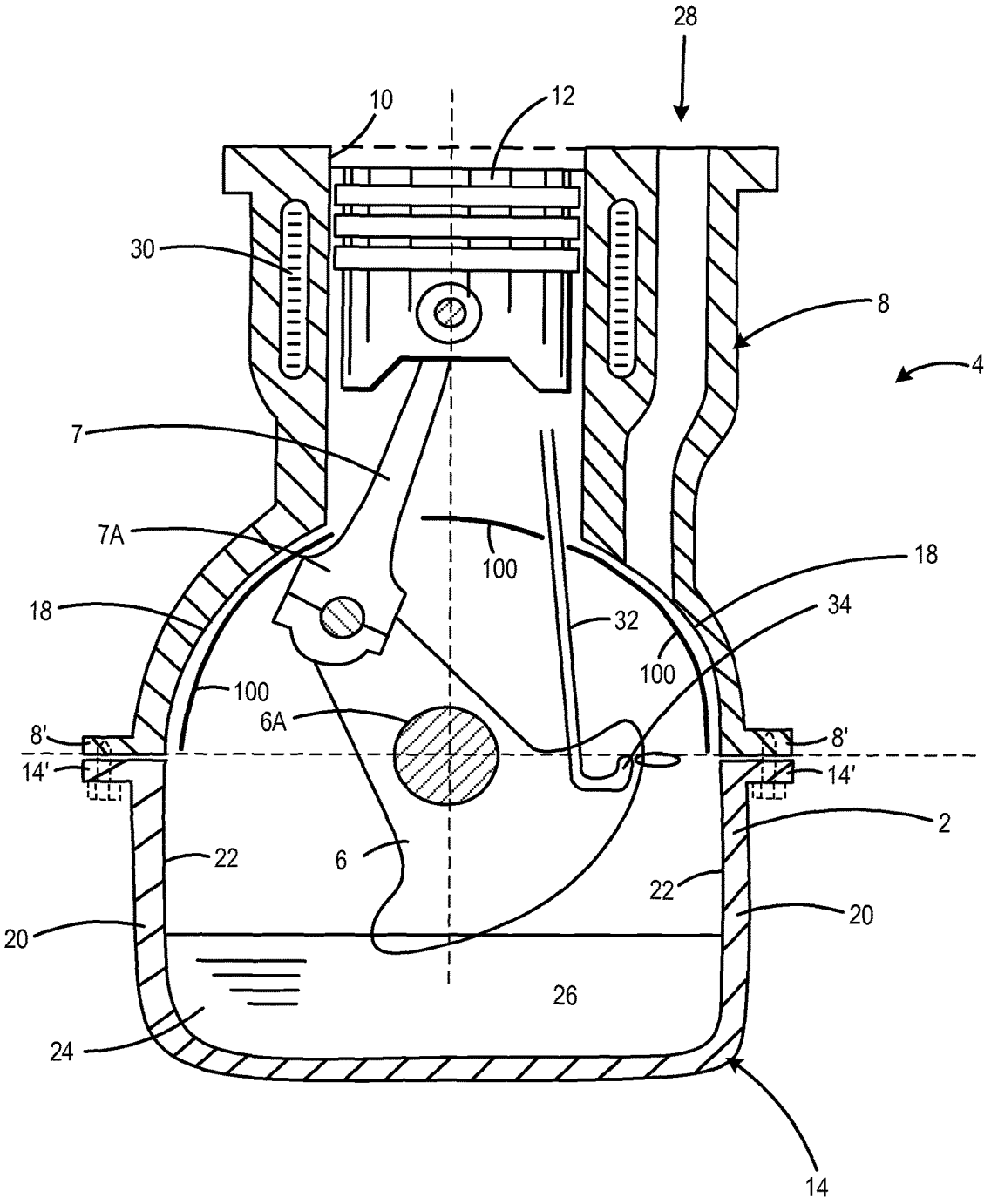
FIG. 1 shows a side sectional view of an engine including a crankcase oil catcher according to an example of the present disclosure.
Figure 2:
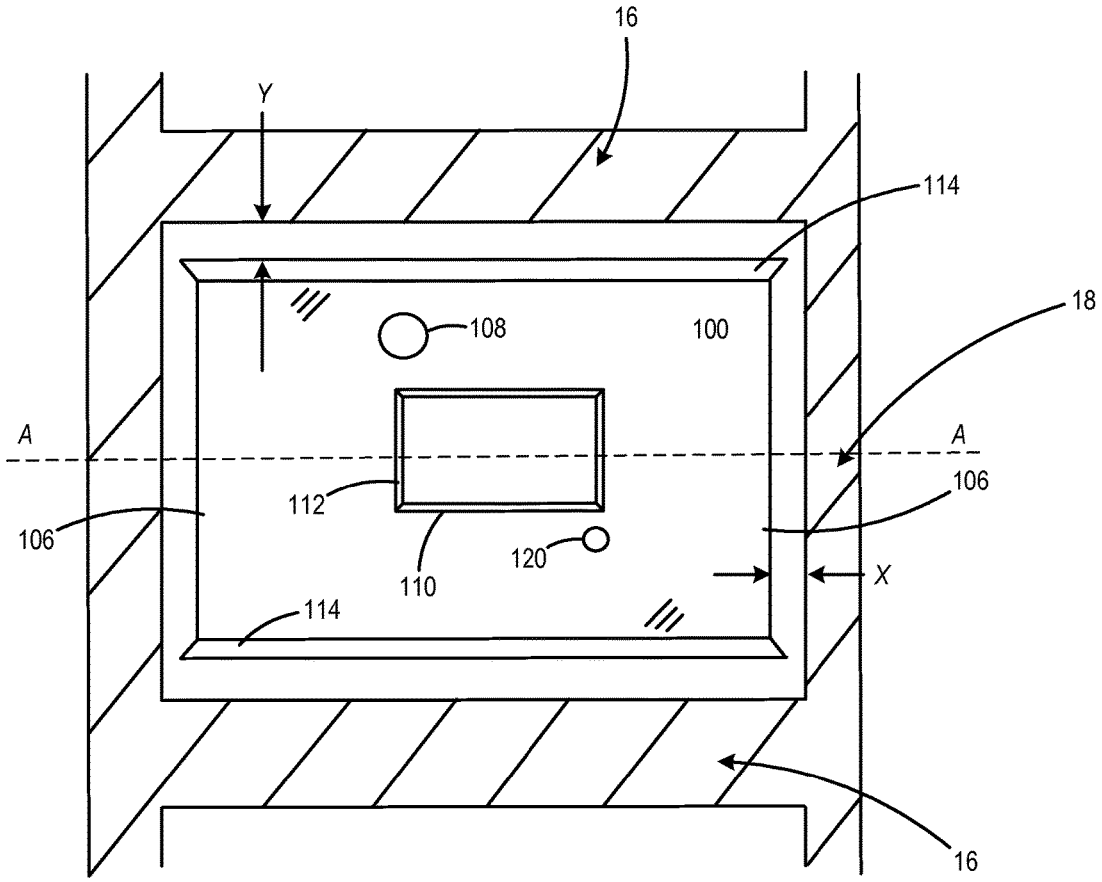
FIG. 2 shows a plan view of the crankcase oil catcher according to the example of the present disclosure.
Figure 3:
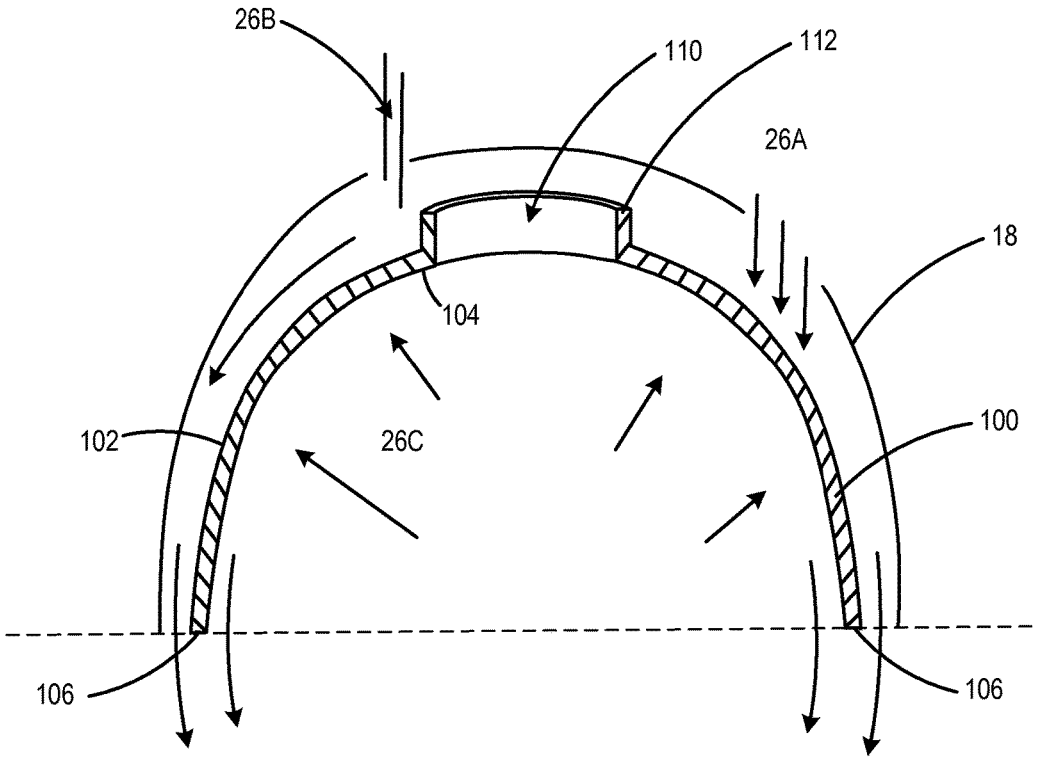
FIG. 3 shows a further side sectional view of the crankcase oil catcher according to the example of the present disclosure and is taken along section A-A shown in FIG. 2.
Figure 4A:
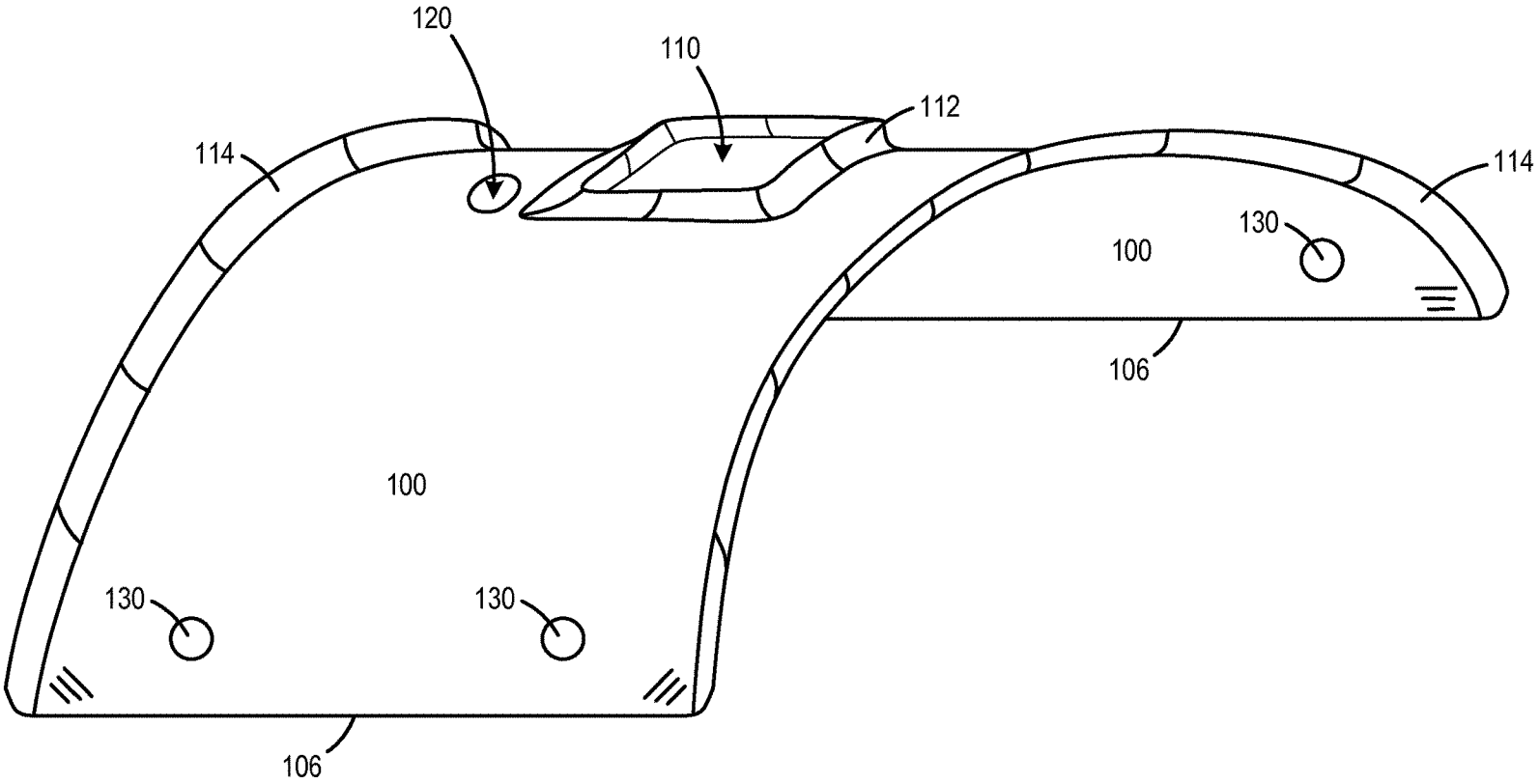
FIGS. 4A and B show exemplary crankcase oil catchers in a perspective view according to the present disclosure.
Figure 4B:
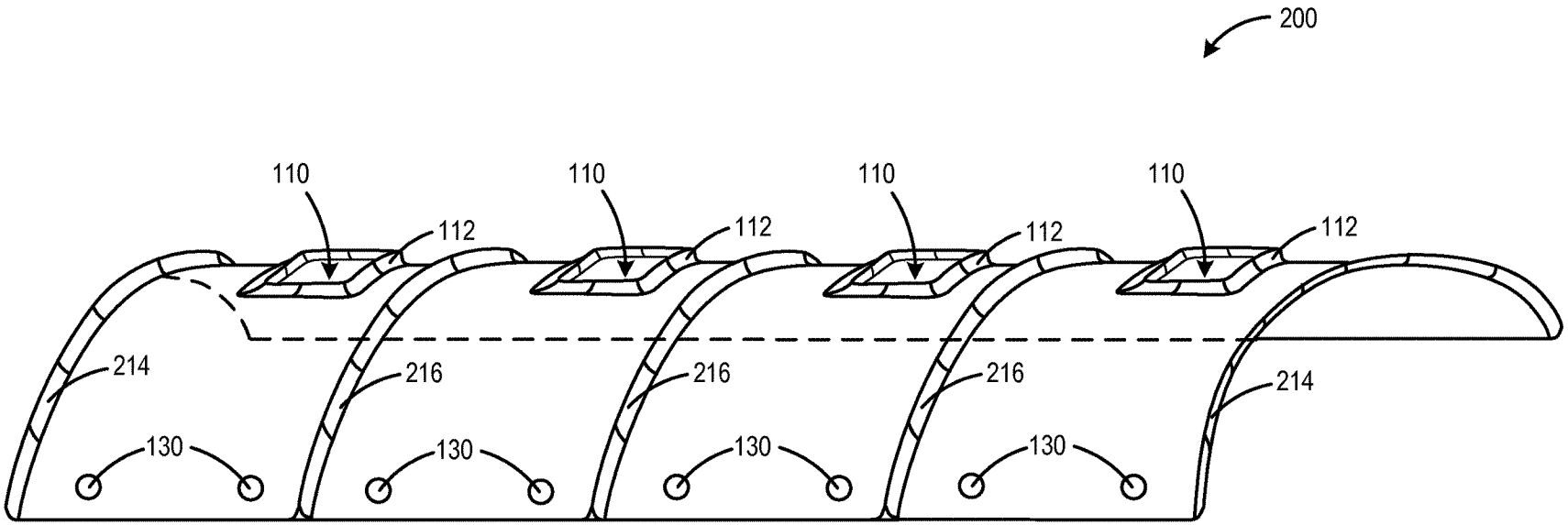

Herein, the crankcase oil catcher is described with respect to one cylinder, although the engine may comprise one or more cylinders within a crankcase that are arranged above a crankshaft extending through the crankcase. FIG. 1 schematically illustrates the relative arrangement of the crankcase oil catcher to a piston coupled to the crankshaft by a connecting rod, the crankcase oil catcher positioned below the piston of the engine and above the crankshaft. FIG. 2 then shows a plan view of the crankcase oil catcher to illustrate first and second apertures, as well as protruding lips included within the crankcase oil catcher. FIG. 3 shows exemplary oil flows to show how the crankcase oil catcher is configured to direct oil along surfaces of the crankcase oil catcher away from a crankcase casing wall and towards a crank sump. FIGS. 4A and B show exemplary crankcase oil catchers in a perspective view according to the present disclosure. For example, FIG. 4A is included to illustrate the crankcase oil catcher in a perspective view to show the various structural features disclosed, which may lead to reduced oil contact with the engine structure of the crankcase in the engine described. FIG. 4B shows an exemplary illustration wherein the crankcase oil catcher extends beneath a plurality of pistons.

According to an aspect of the present disclosure there is provided a crankcase oil catcher, the crankcase oil catcher comprising one or more surfaces configured to catch dispersed oil in a crankcase and direct the oil along the surfaces of the crankcase oil catcher away from a crankcase casing wall and towards a crank sump.

The crankcase oil catcher may be configured to be provided above a crankshaft. The crankcase oil catcher may be further configured to be provided below a piston associated with the crankshaft. In other words, the crankcase oil catcher may be provided beneath an engine cylinder. With this arrangement, the crankcase oil catcher may comprise a first aperture for a connecting rod to pass through. In addition, the width of the first aperture in a direction perpendicular and/or parallel to a longitudinal axis of the crankshaft may be smaller than the corresponding width of the associated engine cylinder to allow for increasing the amount of oil caught from the engine cylinder.

The crankcase oil catcher may further comprise a first lip provided around an edge defining the first aperture. The first lip may protrude from a top surface of the crankcase oil catcher, and in particular, may protrude in a direction towards the piston. To allow for a piston cooling jet, the crankcase oil catcher may comprise a second aperture for passage of the piston cooling jet therethrough, or for receiving a duct for delivering a piston cooling jet. As noted above for the first aperture, a lip may also be provided around an edge defining the second aperture.

As described in greater detail below, the crankcase oil catcher may be configured to be spaced apart from the crankcase casing wall within the crankcase. That is, the crankcase oil catcher may be configured to substantially follow the contour of the crankcase casing wall. In particular, the crankcase oil catcher may be configured to substantially follow the contour of the crankcase casing wall in a plane perpendicular to a longitudinal axis of the crankshaft extending through the crankcase. A gap between the crankcase casing wall and the crankcase oil catcher may be between approximately 4 and 10 mm. The advantage a configuration wherein the top surface has a contour that follows a contour of a crankcase wall while maintaining a substantially constant spacing therefrom is that the top surface allows dispersed oil in the engine crankcase to be caught and directed to a crank sump along the top surface of the crankcase oil catcher while preventing oil from contacting the crankcase casing wall, which may prevent thermal loss.

A bottom surface of the crankcase oil catcher may also be included that is oriented to face the crankshaft. The bottom surface may be configured to catch oil dispersed by a crankshaft, e.g., oil dispersed by a connecting rod and/or by a bearing between the crankshaft and the connecting rod. As noted above, the crankcase oil catcher may also comprise a top surface. The top surface may face the piston and be configured to catch oil returning from above the crankcase, e.g., from a piston cooling gallery, a cylinder head or any other source of oil.

The crankcase oil catcher may also comprise one or more second lips. The second lips may be provided on one or more edges of the crankcase oil catcher surfaces, e.g., on a top and/or bottom surface of the crankcase oil catcher. The second lips may protrude above the top surface and/or below the bottom surface. The one or more second lips may be provided on edges of the crankcase oil catcher surfaces adjacent to the walls between neighboring cylinders of the engine. The one or more second lips may be provided on edges of the crankcase oil catcher surfaces and oriented substantially perpendicular to a longitudinal axis of a crankshaft extending through the crankcase.

With regard to material composition, the crankcase oil catcher may be made from a thermally insulating material. For example, the crankcase oil catcher may be made at least in part from a plastic material, such as nylon. The crankcase oil catcher may be connected to the crankcase casing wall via one or more thermally insulating couplings. Such couplings may be made from a plastic material, e.g. nylon.

Turning to a description of the crankcase oil catcher according to the present disclosure, FIGS. 1-4 relate to crankcase oil catcher 100. Crankcase oil catcher 100 is configured for placement in a crankcase 2 of internal combustion engine 4. Crankcase 2 forms a housing for a crankshaft 6 of the engine. As depicted, crankcase 2 may comprise a portion 8*a* of a cylinder block 8, the portion 8*a* extending below cylinders 10 for pistons 12. Crankcase 2 includes a sump portion 14, which may be coupled to the cylinder block portion 8*a* via flanges 8' and 14'. Although not shown, other arrangements may apply. For example, the crankcase and cylinder block may be integral or the crankcase and cylinder block may be separate discrete components.

FIG. 1 shows a side sectional view of engine 4 including crankcase oil catcher 100 according to an example of the present disclosure. As depicted in FIG. 1, crankcase oil catcher 100 is provided above the crankshaft 6 and below piston 12. Accordingly, the crankcase oil catcher is provided beneath engine cylinder 10. Furthermore, as shown in FIG. 2, crankcase oil catcher 100 may be provided between walls 16. The walls 16 divide neighboring cylinders 10 and may extend below the cylinders 10 into the crankcase 2. The walls 16 may provide supports for crankshaft bearing housings (not shown) and may be part of the cylinder block casting 8. Accordingly, one crankcase oil catcher 100 may be provided per cylinder 10 and associated piston 12. However, in alternative arrangements, the crankcase oil catcher may extend over any number of cylinders 10.

According to the present description, the crankcase oil catcher may be configured to be spaced apart from a crankcase casing wall while preventing oil on a surface from contacting the crankcase casing wall. In particular, as described, the crankcase oil catcher may include a contoured surface that substantially follows a contour of the crankcase casing wall in a plane perpendicular to a longitudinal axis of the crankshaft that extends through the crankcase. More specifically, the crankcase oil catcher may be configured to be spaced apart from the crankcase casing wall. Said differently, the crankcase oil catcher may maintain a spacing by including, e.g., a gap between 4 and 10 mm that is maintained between the crankcase casing wall and the crankcase oil catcher.

FIG. 1 shows one such spacing wherein crankcase oil catcher 100 is shown spaced apart from an inner surface 18 of crankcase 2. The inner surface 18 may be towards the top of crankcase 2 and, in the particular example shown, the inner surface 18 may be provided on the portion 8*a* of cylinder block 8 that extends below cylinders 10. The crankcase oil catcher 100 may be substantially planar, e.g., plate-like, for example, with a thickness less than 1% of its length or width. As FIG. 1 indicates, crankcase oil catcher 100 may lie in a plane that at least partially follows the contours of inner surface 18 of crankcase 2. As a result, the crankcase oil catcher 100 may be substantially parallel to inner surface 18. The inner surface 18 and thus crankcase oil catcher 100 may therefore trace out one or more arcs of a circle in a plane perpendicular to the crankshaft longitudinal axis 6*a*. The center of the circle may substantially correspond to the longitudinal axis 6*a* of the crankshaft, e.g. the axis about which the crankshaft rotates. By contrast, the inner surface 18 and thus crankcase oil catcher 100 may be substantially straight in a direction parallel to the crankshaft longitudinal axis 6*a*. As a result the crankcase oil catcher 100 may at least partially correspond to a sector of a substantially cylindrical tube.

The crankcase oil catcher 100 may fit in a space between the crankcase inner wall 18 and an arc traced out by crankshaft 6 and a big end 7*a* of connecting rod 7 as the crankshaft 6 rotates. As depicted in FIG. 2, a gap X, e.g., in a radial direction, may exist between crankcase casing wall 18 and crankcase oil catcher 100. Gap X may vary or may be substantially constant, e.g., along the surface of the crankcase oil catcher. Gap X may fall in a range between approximately 4 and 10 mm. Similarly, a gap Y may exist between the dividing walls 16 and crankcase oil catcher 100. Gap Y may also be substantially constant. Gap Y may be small, and fall in a range between approximately 1 and 10 mm.

Returning to FIG. 1, sump walls 20 with inner facing sump surfaces 22 may be provided below the curved inner surface 18 of the crankcase 2. The sump walls 20 may be provided at either side of crankshaft 6. Sump surfaces 22 may be substantially straight and parallel. As shown in FIG. 1, the sump surfaces 22 may be coincident with a tangent of inner surface 18 at the interface between sump surfaces 22 and inner surface 18. The sump walls 20 may form part of the sump portion 14, which may or may not be integral with casing potion 8*a*. The sump walls 20 may define a sump 24 which contains the oil 26 in crankcase 2.

Continuing with a description of the crankcase oil catcher, FIG. 1 further shows that crankcase oil catcher 100 may extend downwards to a point substantially level with crankshaft longitudinal axis 6*a*. Accordingly, in the case of crankcase oil catcher 100 substantially tracing out an arc of a circle centered about the crankshaft longitudinal axis 6*a*, the crankcase oil catcher 100 may subtend an angle of approximately 180°. However, alternative arrangements are possible and in alternative arrangements the crankcase oil catcher may extend to a point above the crank longitudinal axis, e.g., the crankcase oil catcher 100 may subtend an angle of less than 180°. This arrangement may be advantageous since oil running off oil catcher 100 may be spaced further from sump surfaces 22 as oil falls into the sump 24. Alternatively, the crankcase oil catcher may extend to a point below the crank longitudinal axis 6*a*. For example, the crankcase oil catcher may follow the sump surfaces 22, which may be substantially straight, as depicted. In some instances, the crankcase oil catcher may even extend into oil sump 24, e.g., below the oil level during use.

With respect to the direction of oil flow, crankcase oil catcher 100 comprises surfaces, which are configured to catch oil dispersed in crankcase 2 and direct the oil along the surfaces of the crankcase oil catcher away from the crankcase walls, e.g., 18 and 22, and towards crank sump 24. In particular, crankcase oil catcher 100 comprises a top surface 102, which when installed faces the piston 12. Furthermore, the crankcase oil catcher 100 comprises a bottom surface 104, which when installed faces the crankshaft 6. In this way, the crankcase oil catcher is positioned such that a top surface of the crankcase oil catcher catches oil returning from above the crankcase, and wherein a bottom surface of the crankcase oil catcher catches oil dispersed by one or more of the crankshaft and a bearing between the crankshaft and the connecting rod.

As one example, a crankcase oil catcher is described that is configured for placement above a crankshaft and below a piston of an engine. In one configuration, the crankcase oil catcher comprises one or more contoured surfaces for catching dispersed oil in the crankcase and directing the dispersed oil along the one or more contoured surfaces of the crankcase oil catcher to a crank sump, and a first aperture for a connecting rod of the crankshaft to pass through. The crankcase oil catcher may further comprise a protruding first lip extending around a perimeter of the first aperture that prevents oil on a top surface of the crankcase oil catcher from falling through the first aperture. In particular, the first aperture may be sized for only passage of the connecting rod of the crankshaft, and the width of the first aperture is made to be smaller than a width of an engine cylinder associated with the connecting rod of the crankshaft, which allows for oil falling from the engine cylinder to land upon the crankcase oil catcher before being directed to the sump via the crankcase oil catcher. As described, the crankcase oil catcher may be configured for placement below a single cylinder of the engine, the crankcase oil catcher being provided between walls of neighboring cylinders of the engine. However, configurations are conceivable wherein the crankcase oil catcher extends beneath a plurality of cylinders.

The crankcase oil catcher according to the present disclosure advantageously allows for the crankcase oil catcher to be spaced apart from a crankcase casing wall, but to maintain a spacing close to the wall, for example, by falling in between 4 and 10 mm. Inclusion of a gap that is maintained relative to the casing wall surface advantageously allows for thermal insulation within the cavity of the engine in some instances. Thereby, oil on the one or more contoured surfaces is prevented from contacting the crankcase casing wall. The one or more contoured surfaces of the crankcase oil catcher may further be configured to substantially follow a contour of the crankcase casing wall, particularly in a plane perpendicular to a longitudinal axis of the crankshaft that extends through the crankcase.

Thus, as another example, a crankcase oil catcher configured for placement above a crankshaft and below a piston may comprise a top surface having a contour that follows a contour of a crankcase wall while maintaining a substantially constant spacing therefrom, the top surface allowing dispersed oil in the engine crankcase to be caught and directed to a crank sump along the top surface of the crankcase oil catcher while preventing oil from contacting the crankcase casing wall. The crankcase oil catcher may further comprise an aperture with a width smaller than a width of the piston associated with a connecting rod of the engine crankshaft, the aperture sized only for passage of the crankshaft, and a lip protruding in a direction of the piston that extends around a perimeter of the aperture for preventing oil on the top surface from falling through the aperture.

One or more second lips may also be included and provided on one or more surfaces (e.g., top and bottom surfaces) of the crankcase oil catcher. The one or more second lips may be further provided on one or more edges of the crankcase oil catcher, the one or more edges including an edge of the crankcase oil catcher located adjacent to the casing wall located between neighboring cylinders of the engine. With this arrangement, oil on a surface of the crankcase oil catcher may be directed to the sump without falling over a side edge of the apparatus. In some instances, a second aperture sized for passage of one or more of a piston cooling jet and a receiving duct for delivering the piston cooling jet may also be included.

In yet another example, an engine or vehicle may comprise one or more cylinders within a crankcase arranged above a crankshaft that extends through the crankcase, a piston positioned within each cylinder that is coupled to the crankshaft by a connecting rod, a crankcase oil catcher placed below each piston of the engine and above the crankshaft. The crankcase oil catcher may be configured to direct oil along surfaces of the crankcase oil catcher away from a crankcase casing wall and towards a crank sump, wherein the crankcase oil catcher includes a first aperture sized for passage of only the connecting rod, and the crankcase oil catcher is configured to maintain a spacing apart from the crankcase casing wall. As noted above, the engine may be configured to receive the crankcase oil catcher while maintaining a spacing from the crankcase casing wall via a gap that falls in a range of 4 to 10 mm. When included in an engine, the first aperture may have a width in one or more of a direction perpendicular and a direction parallel to a longitudinal axis of the crankshaft that is smaller than a width of an engine cylinder associated with the connecting rod that passes through the first aperture. As described above, the first aperture may also include a protruding first lip that prevents oil on a top surface from falling through the first aperture. One or more second lips may also be provided on an edge of the crankcase oil catcher and arranged substantially perpendicular to the longitudinal axis of the crankshaft extending through the crankcase. In addition, a second aperture may also be included for passage of one or more of a piston cooling jet and a receiving duct for delivering the piston cooling jet. When included in an engine, the crankcase oil catcher may be positioned such that a top surface of the crankcase oil catcher catches oil returning from above the crankcase, and a bottom surface of the crankcase oil catcher catches oil dispersed by one or more of the crankshaft and a bearing between the crankshaft and the connecting rod. The crankcase oil catcher may also be made at least partially from one or more of a thermally insulating material, a plastic material and nylon to reduce heat losses when contact is made with a heated oil in the engine.

FIG. 2 shows a plan view of the crankcase oil catcher according to the example of the present disclosure. Crankcase oil catcher 100 may comprise a first aperture 110 for the connecting rod 7 to pass through. The crankcase oil catcher shown includes a first aperture sized for only passage of the connecting rod 7. The advantage of this sizing is that the width of first aperture 110 in a direction perpendicular to the longitudinal axis 6*a* of the crankshaft may be smaller than the corresponding width of the associated engine cylinder 10. Additionally or alternatively, the width of the first aperture 110 in a direction parallel to the longitudinal axis 6*a* of the crankshaft may also be smaller than the corresponding width of the associated engine cylinder 10. As a result, oil falling down the side of cylinder 10 may be caught by the crankcase oil catcher 100, and further directed to the sump without contacting a casing wall and/or connecting rod of the engine.

FIG. 3 shows a further side sectional view of the crankcase oil catcher according to the example of the present disclosure taken along section A-A of FIG. 2. As shown in FIG. 3, crankcase oil catcher 100 may comprise a first lip 112 provided around an edge defining the first aperture 110. The first lip 112 may protrude from the top surface 102 of the crankcase oil catcher, and in particular, may protrude in a direction towards piston 12. Inclusion of first lip 112 may prevent oil on the top surface 102 from falling through first aperture 110.

Note that FIGS. 1-3 illustrate relative positioning, including spatial positioning. For example, elements positioned adjacent to one another may be in direct contact with each other and contiguous with one another, whereas elements positioned spaced apart from one another may have a void or unfilled open space therebetween, and so on.

As shown in FIGS. 2 and 4, crankcase oil catcher 100 may additionally or alternatively comprise a pair of second lips 114. The second lips 114 may be provided on edges of the crankcase oil catcher adjacent to walls 16 between neighboring cylinders 10. Accordingly, the second lips 114 may be provided on the two edges of the crankcase oil catcher that are substantially perpendicular to the crankshaft longitudinal axis 6*a*. As shown, second lips 114 may protrude above the top surface 102. As a result, the second lips 114 may prevent oil on the top surface 102 from falling over the edge adjacent to walls 16.

The crankcase oil catcher 100 may further comprise a second aperture 120 for a piston cooling jet 32 to pass through. The piston cooling jet 32 may be delivered from an oil duct 34, which directs the jet of oil through the second aperture 120 and towards piston 12. Alternatively, the duct for delivering cooling jet 32 may extend through the second aperture 120. As described above for first aperture 110, an upwardly projecting lip (not shown) may also be provided around an edge defining second aperture 120.

The top surface 102 of crankcase oil catcher 100 may be configured to catch oil returning from above in the crankcase, such as oil 26*a* returning from a cylinder head through passage 28 and/or oil 26*b* returning from cylinder 10, e.g., from a piston cooling gallery 30 disposed about cylinder 10. Accordingly, crankcase oil catcher 100 may extend over the cylinder head oil drain passage 28 and/or a piston cooling gallery drain passage (not shown). For example, oil returning from the piston cooling gallery 30 may flow onto the top surface 102 at a point 108 on the top surface. Oil collected on the top surface 102 may then flow along the top surface by virtue of gravity, and flow until reaching a bottom edge 106 of the crankcase oil catcher 100 at which point the oil falls into sump 24.

The bottom surface 104 may be configured to catch oil 26*c* dispersed by crankshaft 6 and/or by the connecting rod big end 7*a*, e.g., as they pass through the oil 26 in sump 24. Oil collected on bottom surface 104 may flow along the bottom surface by virtue of gravity and held on the surface by virtue of the oil's surface tension. The oil on the bottom surface may also flow until reaching the bottom edge 106 of the crankcase oil catcher 100 at which point the oil falls into sump 24.

In either case, the top and bottom surfaces 102, 104 may prevent oil returning to sump 24 from contacting the crankcase walls 18, 16, 20, which may thereby substantially minimize the heat lost by oil contacting crankcase 2. Moreover, oil returning from above the crankcase may be prevented from simply falling directly into the crankcase, hitting the crankshaft or connecting rod and being flung out to the casing walls. In addition, the crankcase oil catcher 100 and air gap associated therewith between the crankcase oil catcher and crankcase inner surface 18 act as a thermal insulation barrier. During operation, the motion of crankshaft 6 and connecting rods 7 creates a rotating flow of gas with oil mist in the crankcase. Such flows result in additional heat losses due to forced convection from the hot gases to the colder crankcase wall. Therefore, addition of the oil catcher 100 and air gap between it and inner surface 18 allows for the amount of conduction and forced heat convection from the gas motion, as well as heat loss from the hot oil, to be reduced.

FIGS. 4A and B show exemplary crankcase oil catchers in a perspective view according to the present disclosure. For example, FIG. 4A is included to illustrate the crankcase oil catcher in a perspective view to show the various structural features disclosed in an arrangement wherein the crankcase oil catcher is provided below a single cylinder. Alternatively, FIG. 4B shows an exemplary illustration wherein the crankcase oil catcher extends beneath a plurality of pistons. As described in greater detail above, the crankcase oil catcher may lead to reduced oil contact with engine structures within the crankcase of the engine.

FIG. 4A shows a crankcase oil catcher with a semi-circular shape. Although described as a semi-circle that follows the contour of the casing wall of the crankcase, this is non-limiting. Other shapes are possible and may depend on the shape of the casing wall in which the crankcase oil catcher is to be located in some instances. As described in detail above, the semi-circular shape having a downward concavity away from a cylinder allows for placement of crankcase oil catcher 100 above the crankshaft and below a piston of the cylinder.

First aperture 110 is also shown and includes a protruding first lip 112 extending around a perimeter of the first aperture that prevents oil on a top surface of the crankcase oil catcher 100 from falling through the first aperture and onto the connecting rod and/or crankshaft associated therewith. In this way, the first aperture 110 is sized only for passage of a connecting rod of the crankshaft (not shown). In addition, a width of the first aperture is made smaller than a width of an engine cylinder associated with the connecting rod of the crankshaft to increase the amount of oil caught by the crankcase oil catcher that falls from a cylinder above. Thereafter, oil falling on a top surface of crankcase oil catcher 100 may be directed along the surface and toward a sump located below the crankcase oil catcher.

The crankcase oil catcher 100 shown also includes a pair of second lips 114. As described above with respect to FIG. 2, second lips 114 may be provided on edges of the crankcase oil catcher adjacent to walls 16 between neighboring cylinders 10 (not shown). Accordingly, the second lips 114 may be provided on the two edges of the crankcase oil catcher that are substantially perpendicular to the crankshaft longitudinal axis 6*a*. The exemplary second lips 114 shown protrude above top surface 102 and prevent oil on the top surface 102 from falling over the edge adjacent to walls, e.g., the walls between neighboring cylinder.

The crankcase oil catcher also includes thermally insulated couplings 130 that allow for connecting the crankcase oil catcher to casing wall 18. Although two such couplers are illustrated at 130, in some instances more or fewer may be present. The couplings may also be located in different positions than the exemplary positions provided. For example, the couplings may comprise a fir tree type fitting, screws or any other suitable coupling received in an opening of crankcase wall 18.

FIG. 4B shows an exemplary illustration wherein crankcase oil catcher 200 extends beneath a plurality of pistons. Specifically, crankcase oil catcher 200 is shown for an engine having an inline four engine configuration. However, other engine arrangements are possible. For example, engines with greater or fewer cylinders, and engines with a different arrangement of cylinders are also possible. As described above with respect to FIG. 4A, exemplary crankcase oil catcher 200 also has a semi-circular shape for directing the flow of oil downward and toward the sump. Likewise, a first aperture 110 is included with a protruding first lip 112 for passage therethrough of each connecting rod of the inline four engine.

The configuration shown further includes two different types of second lips. For example, second edge lips 214 are provided on edges of the crankcase oil catcher. However, second internal lips 216 are included between each cylinder of the four cylinder engine. Second internal lips 216 are thus not provided on edges of the crankcase oil catcher, but instead reside on an internal surface of the apparatus. The advantage of this arrangement is that the internal lips may be molded into the surface and provide a ridge for directing oil along the surface and toward the sump located beneath the crankcase oil catcher. However, in some implementations, second internal lips 216 may also be omitted from the apparatus while second edge lips 214 are included. As described above, crankcase oil catcher 200 also includes thermally insulated couplings 130 for connecting the crankcase oil catcher to a casing wall.

With regards to construction, crankcase oil catcher 100 may be molded or bent into shape during construction. In addition, crankcase oil catcher 100 may be made from a low conducting thermally insulating material, for example, a plastic material, such as nylon. The selection of such a material further reduces and potentially minimizes the thermal energy transferred from oil falling onto the crankcase oil catcher 100. Although not shown, the crankcase oil catcher may additionally be connected to the crankcase casing wall 18 via one or more thermally insulating couplings and such couplings may also be made from a plastic material, e.g., nylon. The couplings may comprise a fir tree type fitting, screws or any other suitable coupling received in openings in crankcase wall 18. The crankcase oil catcher may additionally or alternatively comprise flanges (not shown), which may for example fit between flanges 8' and 14' of cylinder block portion 8*a* and sump portion 14 to hold the crankcase oil catcher in place.

It will be appreciated by those skilled in the art that although the present disclosure has been described by way of example with reference to one or more examples, it is not limited to the disclosed examples and that alternative examples could be constructed without departing from the scope of the invention as defined by the appended claims.

It will be appreciated that the configurations disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A crankcase oil catcher configured for placement above a crankshaft and below a piston of an engine, comprising:

one or more contoured surfaces for catching dispersed oil in the crankcase and directing the dispersed oil along the one or more contoured surfaces of the crankcase oil catcher to a crank sump, and a first aperture for a connecting rod of the crankshaft to pass through, the crankcase oil catcher further configured for placement below a single cylinder of the engine, the crankcase oil catcher provided between walls of neighboring cylinders of the engine.

2. A crankcase oil catcher configured for placement above a crankshaft and below a piston of an engine, comprising:

one or more contoured surfaces for catching dispersed oil in the crankcase and directing the dispersed oil along the one or more contoured surfaces of the crankcase oil catcher to a crank sump, a first aperture for a connecting rod of the crankshaft to pass through, and a protruding first lip extending around a perimeter of the first aperture that prevents oil on a top surface of the crankcase oil catcher from falling through the first aperture.

3. The crankcase oil catcher of claim 2, wherein the first aperture is sized for only passage of the connecting rod of the crankshaft.

4. The crankcase oil catcher of claim 3, wherein a width of the first aperture is smaller than a width of an engine cylinder associated with the connecting rod of the crankshaft.

5. The crankcase oil catcher of claim 4, wherein the crankcase oil catcher is configured to be spaced apart from a crankcase casing wall while preventing oil on the one or more contoured surfaces from contacting the crankcase casing wall.

6. The crankcase oil catcher of claim 5, wherein the one or more contoured surfaces of the crankcase oil catcher is further configured to substantially follow a contour of the crankcase casing wall in a plane perpendicular to a longitudinal axis of the crankshaft that extends through the crankcase.

7. The crankcase oil catcher of claim 6, wherein the crankcase oil catcher configured to be spaced apart from the crankcase casing wall includes a gap between 4 and 10 mm that is maintained between the crankcase casing wall and the crankcase oil catcher.

8. The crankcase oil catcher of claim 4, wherein one or more second lips are included and provided on one or more surfaces of the crankcase oil catcher.

9. The crankcase oil catcher of claim 8, wherein the one or more second lips are further provided on one or more edges of the crankcase oil catcher, the one or more edges including an edge of the crankcase oil catcher located adjacent to the casing wall located between neighboring cylinders of the engine.

10. A crankcase oil catcher configured for placement above a crankshaft and below a piston of an engine, comprising:

one or more contoured surfaces for catching dispersed oil in the crankcase and directing the dispersed oil along the one or more contoured surfaces of the crankcase oil catcher to a crank sump, and a first aperture for a connecting rod of the crankshaft to pass through, wherein the crankcase oil catcher includes a second aperture sized for passage of one or more of a piston cooling jet and a receiving duct for delivering the piston cooling jet.

11. An engine, comprising:

one or more cylinders within a crankcase arranged above a crankshaft that extends through the crankcase, a piston positioned within each cylinder that is coupled to the crankshaft by a connecting rod, and a crankcase oil catcher placed below each piston of the engine and above the crankshaft, the crankcase oil catcher configured to direct oil along surfaces of the crankcase oil catcher away from a crankcase casing wall and towards a crank sump, wherein the crankcase oil catcher includes a first aperture sized for passage of only the connecting rod, and the crankcase oil catcher is configured to maintain a spacing apart from the crankcase casing wall.

12. The engine of claim 11, wherein the crankcase oil catcher is configured to maintain a spacing from the crankcase casing wall via a gap that falls in a range of 4 to 10 mm.

13. The engine of claim 12, wherein the first aperture has a width in one or more of a direction perpendicular and a direction parallel to a longitudinal axis of the crankshaft that is smaller than a width of an engine cylinder that is associated with the connecting rod that passes through the first aperture.

14. The engine of claim 13, wherein the first aperture includes a protruding first lip that prevents oil on a top surface from falling through the first aperture.

15. The engine of claim 14, wherein the crankcase oil catcher includes one or more second lips provided on an edge of the crankcase oil catcher arranged substantially perpendicular to the longitudinal axis of the crankshaft extending through the crankcase.

16. The engine of claim 15, wherein the crankcase oil catcher further comprises a second aperture for passage of one or more of a piston cooling jet and a receiving duct for delivering the piston cooling jet.

17. The engine of claim 13, wherein the crankcase oil catcher is positioned such that a top surface of the crankcase oil catcher catches oil returning from above the crankcase, and wherein a bottom surface of the crankcase oil catcher catches oil dispersed by one or more of the crankshaft and a bearing between the crankshaft and the connecting rod.

18. The engine of claim 11, wherein the crankcase oil catcher is at least partially made from one or more of a thermally insulating material, a plastic material and nylon.

19. A crankcase oil catcher configured for placement above a crankshaft and below a piston, comprising:

a top surface having a contour that follows a contour of a crankcase wall while maintaining a substantially constant spacing therefrom, the top surface allowing dispersed oil in an engine crankcase to be caught and directed to a crank sump along the top surface of the crankcase oil catcher while preventing oil from contacting the crankcase wall, an aperture with a width smaller than a width of the piston associated with a connecting rod of the crankshaft, the aperture sized only for passage of the crankshaft, and a lip protruding in a direction of the piston that extends around a perimeter of the aperture for preventing oil on the top surface from falling through the aperture.

* * * * *